United States Patent [19]

Altman

[11] 4,098,217

[45] Jul. 4, 1978

[54] TRIP-RELEASE ANCHOR

[75] Inventor: Robert E. Altman, West Manchester Township, York County, Pa.

[73] Assignee: Arnold G. Tucker, York, Pa.

[21] Appl. No.: 819,482

[22] Filed: Jul. 27, 1977

[51] Int. Cl.[2] ..... B63B 21/46

[52] U.S. Cl. ..... 114/299; 114/302; 114/304

[58] Field of Search ..... 114/294, 297–299, 114/301–310, 210

[56] References Cited

U.S. PATENT DOCUMENTS

| | | | |
|---|---|---|---|
| 2,606,518 | 8/1952 | Christie | 114/298 |
| 3,024,756 | 3/1962 | Ogg | 114/309 |
| 3,059,607 | 10/1962 | Wheeler | 114/298 |
| 3,518,957 | 7/1970 | George | 114/297 |

*Primary Examiner*—Trygve M. Blix

*Assistant Examiner*—Stuart M. Goldstein

*Attorney, Agent, or Firm*—Charles J. Long

[57] ABSTRACT

An anchor of the twin fluke type in which crown members attached to the flukes support transverse restraining bars adapted to limit swing of the shank out of the plane of the flukes. One end of each restraining bar is pivotally connected to its respective crown member, and the other end is engaged by a locking member when the bar is in transverse restraining position. A release line connected to each locking member extends substantially coextensively with the anchoring line and is adapted to be pulled to remove the locking member from whichever restraining bar is engaging the shank, thereby permitting the restraining bar to pivot out of restraining position and permitting the shank to swing up to 180° from the plane of the flukes so that the anchor can be pulled clear of obstructions.

10 Claims, 4 Drawing Figures

TRIP-RELEASE ANCHOR

BACKGROUND OF THE INVENTION

1. Field of the Invention

This invention relates to anchors for boats and other floating vessels. More particularly the invention relates to twin fluke anchors in which the shank can be released to swing freely up to 180° out of the plane of the fluke when necessary to free the anchor from underwater obstructions, which otherwise would prevent hoisting the anchor by hand.

2. Description of the Prior Art

Those who use twin fluke anchors, particularly with small to medium-sized pleasure boats, are aware that in use it is not unusual for an underwater obstruction such as a boulder, log, or the like to become lodged between the flukes and the shank. In a typical twin fluke anchor of the prior art, the swing of the shank out of the plane of the flukes is permanently limited to an acute angle such as 35° on either side of the flukes. When such an anchor catches an underwater obstruction between the flukes and shank, it is very difficult, and sometimes impossible, to retrieve the anchor by hand. On large ships equipped with hoists the problem is not so severe because in many such cases the hoist is powerful enough to pull both anchor and obstruction free from the lake or river bottom; however, most small pleasure craft are not so equipped and many anchors have been abandoned because they could not be retrieved by hand.

Prior workers have attempted to solve the problem of fouled anchors in several ways, none of which is entirely satisfactory.

One approach is exemplified by U.S. Pat. No. 2,856,882; in this approach the flukes are pivotally connected to a hollow shank and the normal swing of the shank is limited by a mechanism associated with spring means located within the shank. Depending on the specific design, either release of the normally restrained spring or a pull gainst the spring force, both accomplished by pulling on the anchoring line from the anchored vessel, causes the restraint on the shank's movement the be removed so that the shank can swing as much as 180° out of the plane of the flukes and the anchor can thereby be pulled clear of the obstruction. On retrieval of the anchor the spring mechanism is reset to again limit swing of the shank. The principal difficulties of this approach are that construction of the anchor is inherently complex due to the necessity for a spring, a hollow shank portion to contain the spring, and at least two parts to the shank (including the hollow portion); material selection is difficult because the spring and associated mechanism must resist the corrosion of various marine environments, which usually requires use of expensive alloys; and in most cases the arrangement is such that the flukes can be released unintentionally, as by the pulling force exerted on the anchoring line if a high wave lifts the anchored vessel.

A second approach to the retrieval of fouled anchors is set forth, for example, in U.S. Pat. No. 3,404,652. In this and several similar patents the normal swing of the shank is limited by one or more frangible elements; when the anchor becomes caught on an obstruction, a pull on the anchoring line is intended to break one of the frangible elements and allow the shank to swing free. One problem with such an anchor is that each time it is extricated from an obstruction by breaking a fragible element, the element must be replaced; although the cost of such elements is presumably low, the necessity for replacement and for keeping spares on hand is an inconvenience. Another problem is that if the frangible elements are not strong enough, an unintended pull, as by a high wave, may cause them to break, whereas if they are too strong it may be impossible to break them when desired.

Other prior approaches to the problem, all of which have difficulties similar to the foregoing, i.e. complexity and/or lack of assured control of when release will occur, include use of spring mechanisms acting on the transverse shaft to which the flukes are attached, exemplified by U.S. Pat. No. 3,045,633, and a design in which a rearward impulsive force mechanism built into the anchor ca be triggered to in effect "kick" the anchor rearwardly out of engagement with the obstruction, as in U.S. Pat. No. 3,518,957.

In view of the shortcomings of prior art devices and the rapid increase of pleasure boating in recent years, there has been a growing need for a simple, yet strong and dependable anchor which can be retrieved by hand when fouled by underwater obstructions. I provide such an anchor which in one embodiment has additional advantages with regard to storage on the boat when not in use.

SUMMARY OF THE INVENTION

In accordance with the invention, I provide a trip-release anchor comprising an elongated shank; an anchoring line extending from one end of the shank to a floating vessel; a transverse shaft rotatably supported at the other end of the shank; a pair of coplanar flukes secured along their rear marginal edges to the shaft on opposite sides of the shank, with their inner edges spaced from the shank; two pairs of transversely spaced crown members attached respectively to opposite sides of the flukes and extending rearwardly at an acute angle to the flukes; two restraining bars respectively pivotally connected at one end to one crown member of each pair and extending in a transverse direction to the other crown member of each pair, said restraining bars being adapted to limit to an acute angle the swing of the plane of the flukes; locking members engaging the other ends of the restraining bars to position the same in restraining position; and a release line connected to each locking member, the release line extending substantially coextensively with the anchoring line and adapted to be pulled to remove the locking member from the restraining bar engaging the shank and thereby to permit the restraining bar to be moved freely rom restraining position and permit the shank to swing relative to the flukes beyond its restrained position whereby the anchor can be pulled clear of any obstruction.

In one embodiment, I provide such an anchor in which one member of each pair of transversely spaced crown members is attached to one fluke and the other member attached to the other fluke.

In a preferred embodiment, each crown member comprises a planar plate.

In a further preferred embodiment, the free (i.e. non-pivotally attached) end of each restraining bar is overlaid by a rearwardly open bracket attached to the crown member, the bracket and restraining bar have aligned holes through them, and each locking member comprises a pin received in the aligned holes. I may include in the bracket resilient means biasing the restraining bar against the pins to thereby provide frictional force resisting removal of the pin.

In another embodiment, the aligned holes are transversely positioned so as to be closely adjacent to the inner edge of the fluke to which the bracket and crown member are attached.

For best operation the axis of the pin is parallel to the longitudinal axis of the shank when the shank is engaged by the restraining bar.

In one form, the release line of my anchor comprises an operating line having a loop at one end thereof and a trip line extending through the loop from one pin to the other pin, the ends of said trip line being respectively connected to said pin.

I prefer a design in which the acute angle between the flukes and the crown members is substantially complementary to the acute angle between the longitudinal axis of the shank and the plane of the flukes when the shank is engaged by the restraining bars.

For ease in storing my anchor when not in use, I provide an embodiment in which each crown member includes a rear portion extending parallel to the plane of the flukes.

BRIEF DESCRIPTION OF THE DRAWINGS

In the accompanying drawings I have shown a present preferred embodiment of the invention in which.

DESCRIPTION OF THE PREFERRED EMBODIMENTS

Figure 1:
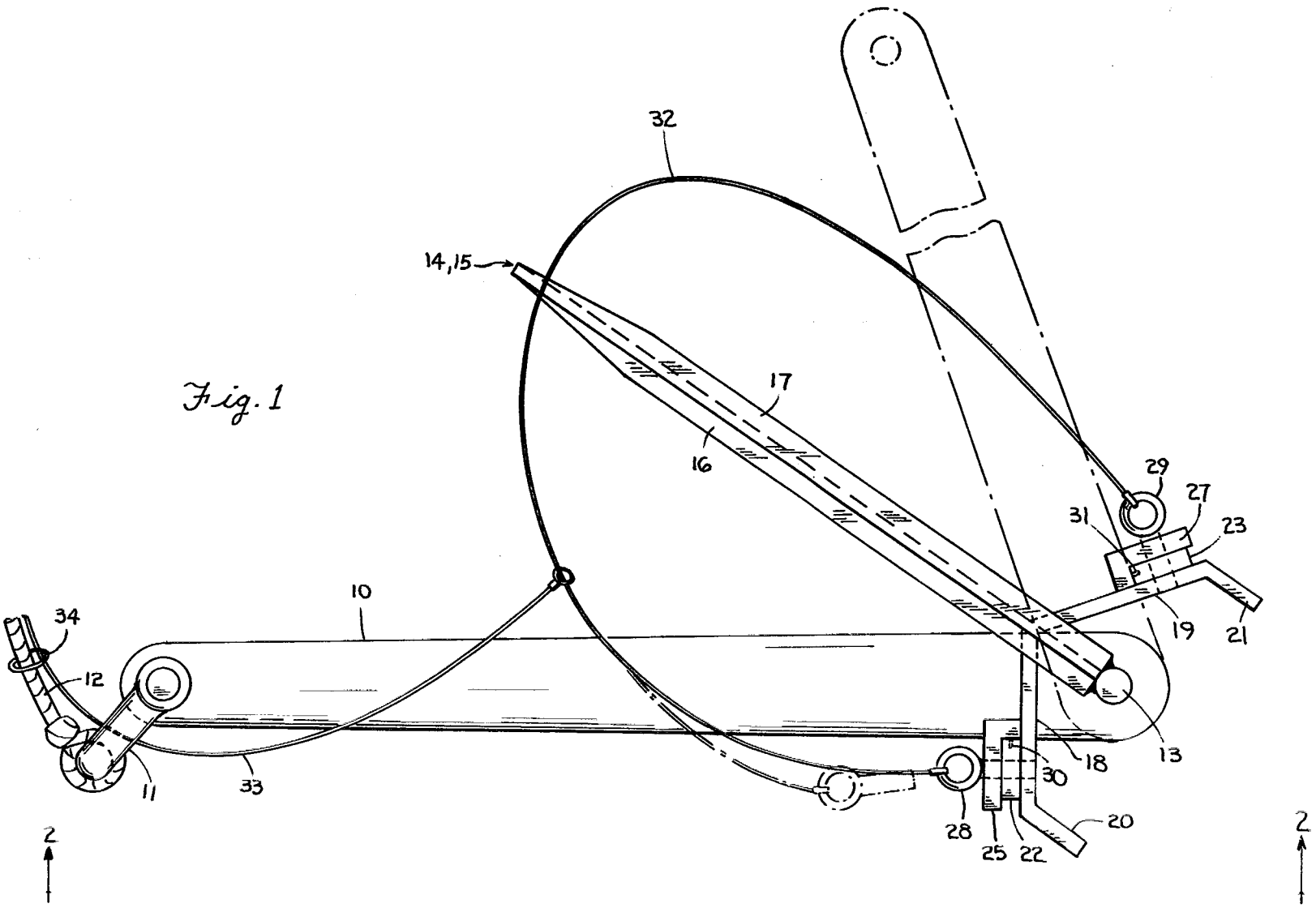
FIG. 1 is a side view of the anchor.

Referring to the drawings, there is shown an elongated shank 10. One end of the shank is secured by means of a clevis 11 to an anchoring line 12, which extends to the boat or other floating vessel (not shown) with which the anchor is used; the other end of the shank 10 rotatably supports a transverse shaft 13, to which a pair of coplanar flukes 14 and 15 are attached at their rear marginal edges.

The flukes 14 and 15 are on opposite sides of the shank 10 and their inner edges are spaced from the shank so as to allow relative rotation between the shank and flukes around the axis of the shaft. Although various fluke shapes may be used satisfactorily in the anchor of my invention, I prefer substantially triangular outwardly tapering flukes, as shown in the drawings, because the spaced apart working points with such shapes provide increased holding power as compared to similarly shaped flukes having the opposite taper — i.e. with working points at the inner edges. For added rigidity each fluke has a flange along its outer edge 16, 17, which may be formed by bending or by attachment of a separate edge piece.

Two pairs of transversely spaced crown members 18, 18' and 19, 19' are attached to opposite sides of the flukes near the inner edges thereof and extend rearwardly at an acute angle to the flukes, one member of each pair being attached to each fluke. I prefer that the crown members comprise planar plates as shown, although other shapes, e.g. cylindrical, could be used. The crown members cause the flukes 14, 15 to rotate away from the shank 10 when the anchor hits the bottom of the river, lake, or the like so that the flukes become oriented to dig in the bottom properly; having crown members on both sides of the fluke ensures that the desired fluke-shank relationship will be achieved no matter which side of the anchor happens to contact the bottom first. For ease in storage, to be discussed somewhat more fully hereinafter, the crown members include rear portions 20, 20', 21, 21' which extend parallel to the plane of the flukes.

Figure 2:
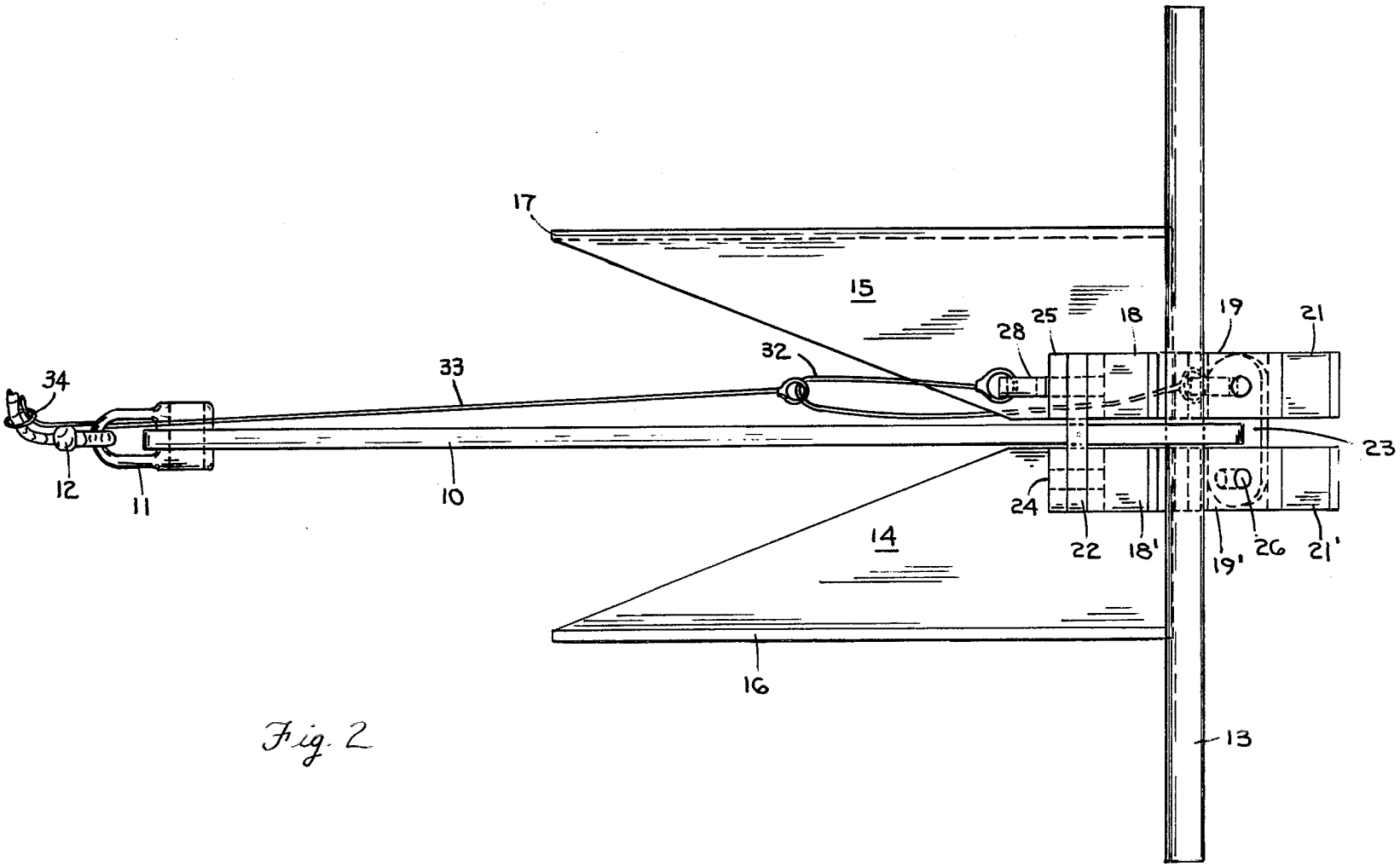
FIG. 2 is a view taken along line 2–2 in FIG. 1 looking in the direction of the arrows.
Figure 3:
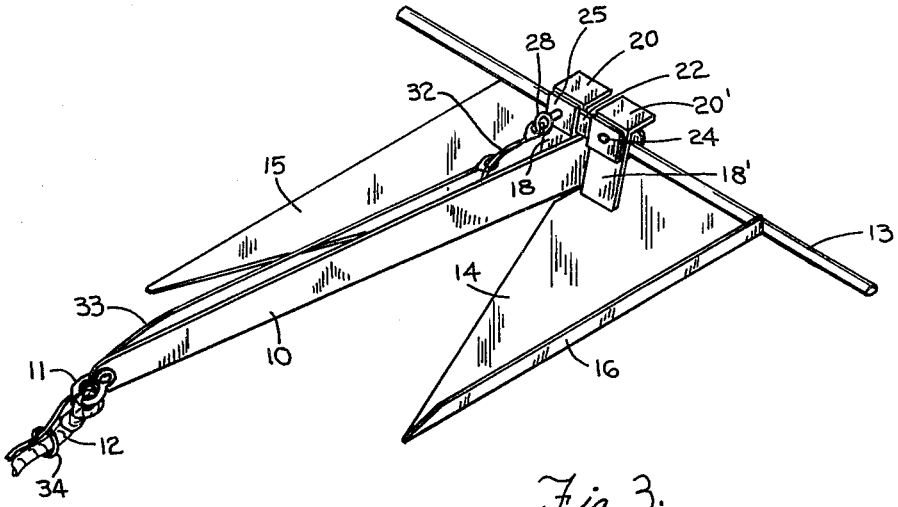
FIG. 3 is a perspective view of the anchor in normal operating orientation.

In normal operating orientation, as shown in FIGS. 1 through 3, a restraining bar 22 extends transversely between crown member 18' and crown member 18 on one side of the flukes and a second restraining bar 23 extends similarly between the crown members on the other side of the flukes. When locked in such transverse position, the restraining bars limit the swing of shank 10 out of the plane of flukes 14 and 15 to an acute angle, typically between 30 and 40° on either side of the flukes, to assure proper holding power of the anchor when in use.

A pivot pin 24 attached perpendicularly to crown member 18' extends with clearance through a hole in one end of restraining bar 22; the restraining bar can be held in place on the pivot pin by any suitable means, such as the overlaying bracket shown in the drawing figures. The other end of restraining bar 22 is overlaid by a rearwardly open bracket 25 attached to crown member 18. The bracket, bar, and crown member contain holes through them which are aligned when the restraining bar is in transverse restraining position. For best operation the holes are located in close proximity to the inner edge of the fluke with which each is associated. Restraining bar 23 is similarly pivotally supported at one end by pivot pin 26 attached to crown member 21; its other end is overlaid by bracket 27 and holes through the bracket, bar and crown member are aligned when the restraining bar is in transverse restraining position.

In order to lock restraining bars 22 and 23 in transverse restraining position, locking members consisting of pins 28 and 29 respectively are received in the above mentioned aligned holes. The locking pins are intended to be removable from the holes by application of pulling force in their axial direction, but it is desirable that they neither fall out by their own weight nor be removed too easily, e.g. by an unintended or accidental light pull. To prevent such unintended removal of the locking pins, short pieces of resilient material 30, 31, mounted at the forward inside surfaces of brackets 25 and 27 respectively, bias restraining bars 22 and 23 against locking pins 28 and 29 respectively when the locking pins are in the aligned holes, and thereby provide frictional force resisting removal of the locking pins. For resilient material I use small segments of rubber O-rings, portions of which I friction fit into blind holes bored into the brackets. It should be noted, however, that other methods can also be used to provide frictional forces resisting removal of the locking pins; for example, the pin receiving holes in the brackets, restraining bars or crown members can be so sized as to provide a light friction fit for the pins.

For best operation of my anchor the axes of locking pins 28 and 29 should be oriented so as to be substantially parallel to the longitudinal axis of shank 10 when the shank engages restraining bars 22 and 23 respectively. In the embodiment shown this is accomplished by drilling the aligned pin-receiving holes perpendicular to the crown member with which each is associated and fixing as the angle between flukes and crown member the complement to the acute angle between flukes and shank when the shank is at the limits of its restrained position. For example, in the anchor shown the restraining bars limit the swing of the shank to about 35° on either side of the flukes and the crown members are set at an angle of 55° to the flukes.

A trip line 32 is connected to and extends between pins 28 and 29, which have rings at their ends to facilitate such connection. Looped at one end around the trip line 32 is an operating line 33 which extends coextensively with the anchoring line 12 to the boat or similar vessel. To keep the operating line coextensive with the anchoring line the former is threaded through a plurality of guide rings, one of which is shown at 34, secured at spaced points along the anchoring line 12.

I may fabricate my anchor from steel or other suitable metal, treated if desired to resist the corrosive effects of marine atmospheres. The dimensions and material of pivot pins 24 and 26 and locking pins 28 and 29 are selected to provide sufficient shear strength to resist breaking or distortion due to the forces exerted by the shank on the restraining bars when the anchor is in use.

Figure 4:
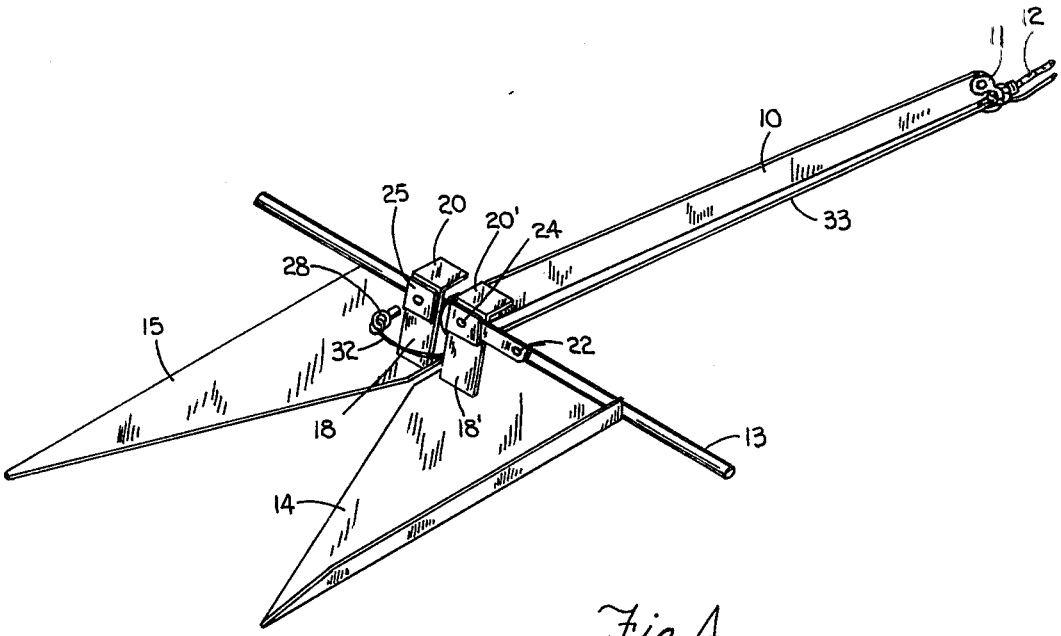
FIG. 4 is a perspective view of the anchor with the shank released.

In operation, my trip-release anchor functions as follows: for normal anchoring, restraining bars 22 and 23 are locked in transverse restraining position by locking pins 28 and 29, and the anchor is dropped from a boat or other floating vessel to the bottom of a river, lake or the like. Viewing FIGS. 1 and 3, let it be assumed that crown members 19, 19' contact the bottom first; when such contact occurs, the flukes are caused to swing downward away from the shank until they are stopped when the shank engages restraining bar 22. Motion of the boat in the appropriate direction drags the anchor, causing the flukes to dig into the bottom of the body of water and hold the boat in the known manner. If the flukes become fouled on a submerged rock, log or the like so that it is necessary to use the trip-release feature, operating line 33 is pulled toward the boat. Such pull exerts a pulling force on trip line 32 and through the trip line on locking pins 28 and 29; the pulling force is substantially parallel to shank 10. Since the axis of locking pin 29 is at a large acute angle, 70° in the drawings, to the direction of the pulling force, the force has little, if any, axial effect on that locking pin; however, the axis of locking pin 28 is in substantially the same direction as the pulling force, so that the pull on operating line 33 removes pin 28 from its locking position in the aligned holes (shown by the broken lines in FIG. 1 and shown in FIG. 1 and shown in FIG. 4) and thereby frees restraining bar 22 to pivot around pivot pin 24 and out of restraining position, permitting shank 10 to swing freely around shaft 13 and away from the flukes, as shown in FIG. 4. The anchor can then be retrieved from the obstruction by merely pulling up on the anchoring line 12. Once retrieved, the anchor can be readied for use again by swinging the shank back within its working range, pivoting restraining bar 22 into restraining position in bracket 25 and inserting locking pin 28 in the aligned holes through bracket 25, bar 22 and crown member 18. It will be appreciated that the same release sequence described above for the case when the anchor strikes bottom with crown members 19 and 19' down will be followed with respect to restraining bar 23 when the anchor strikes bottom with crown members 18 and 18' down.

When not in use, the anchor shown in the drawings is adapted to be stored on the deck of a boat in a vertical position, thereby occupying minimum space. Such storage is readily accomplished because the rear portions 20, 20', 21, 21' of the crown members act as stabilizing feet which hold the flukes in vertical position when resting on the deck of the boat so that the only fixturing necessary is that required to secure the shank in a vertical position and prevent the anchor from being jarred loose.

My anchor is simple and sturdy in construction and yet provides positive control of release of the shank when necessary to dislodge the anchor from underwater obstructions.

While I have shown and described a present preferred embodiment of the invention it is to be distinctly understood that the invention is not limited thereto but may be otherwise variously embodied within the scope of the following claims.

I claim:

1. A trip-release anchor comprising:

an elongated shank;

an anchoring line extending from one end of the shank to a floating vessel;

a transverse shaft rotatably supported at the other end of the shank;

a pair of coplanar flukes secured along their rear marginal edges to the shaft on opposite sides of the shank, with their inner edges spaced from the shank;

two pairs of transversely spaced crown members attached respectively to opposite sides of the flukes and extending rearwardly at an acute angle to the flukes;

two restraining bars respectively pivotally connected at one end to one crown member of each pair and extending in a transverse direction to the other crown member of each pair, said restraining bars being adapted to limit to an acute angle the swing of the shank out of the plane of the flukes;

locking members engaging the other ends of the restraining bars to position the same in restraining position; and a release line connected to each locking member, the release line extending substantially coextensively with the anchoring line and adapted to be pulled to remove the locking member from the restraining bar engaging the shank and thereby to permit said restraining bar to be moved freely from restraining position and permit the shank to swing relative to the flukes beyond its restrained position whereby the anchor can be pulled clean of any obstruction.

2. An anchor as claimed in claim 1, in which one member of each pair of transversely spaced crown members is attached to one fluke and the other member is attached to the other fluke.

3. An anchor as claimed in claim 2, in which each crown member comprises a planar plate.

4. An anchor as claimed in claim 3, in which said other end of each restraining bar is overlaid by a rearwardly open bracket attached to the crown member, the bracket and restraining bar have aligned holes through them, and each locking member comprises a pin received in the aligned holes.

5. An anchor as claimed in claim 4, in which the bracket includes resilient means biasing the restraining bar against the pin to thereby provide frictional force resisting removal of the pin.

6. An anchor as claimed in claim 4, in which the aligned holes are transversely positioned so as to be closely adjacent to the inner edge of the fluke to which the bracket and crown member are attached.

7. An anchor as claimed in claim 6, in which the axis of the pin is parallel to the longitudinal axis of the shank when the shank is engaged by the restraining bar.

8. An anchor as claimed in claim 7, in which the release line comprises an operating line having a loop at one end thereof and a trip line extending through the loop from one pin to the other pin, the ends of said trip line being respectively connected to said pins.

9. An anchor as claimed in claim 8, in which the acute angle between the flukes and the crown members is substantially complementary to the acute angle between the longitudinal axis of the shank and the plane of the flukes when the shank is engaged by the restraining bars.

10. An anchor as claimed in claim 9, in which each crown member includes a rear portion extending parallel to the plane of the flukes.

* * * * *

UNITED STATES PATENT AND TRADEMARK OFFICE

CERTIFICATE OF CORRECTION

PATENT NO. : 4,098,217

DATED : July 4, 1978

INVENTOR(S) : ROBERT E. ALTMAN

It is certified that error appears in the above-identified patent and that said Letters Patent are hereby corrected as shown below:

Column 3, Line 12, delete "pin" and substitute - - pins - - therefor.

Column 5, Line 48, delete "and shown in FIG. 1".

Column 6, Line 48, delete "clean" and substitute - - clear - - therefor.

Signed and Sealed this

*Second* Day of *January 1979*

[SEAL]

*Attest:*

RUTH C. MASON
*Attesting Officer*

DONALD W. BANNER
*Commissioner of Patents and Trademarks*